US005921217A

United States Patent [19]

Koike et al.

[11] Patent Number: 5,921,217

[45] Date of Patent: Jul. 13, 1999

[54] TWO CYCLE ENGINE PROVIDED WITH CATALYST

[75] Inventors: Takashi Koike; Hiroaki Fujimoto, both of Hamamatsu, Japan

[73] Assignee: Sanshin Kogyo Kabushiki Kaisha, Hamamatsu, Japan

[21] Appl. No.: 08/757,731

[22] Filed: Nov. 26, 1996

[30] Foreign Application Priority Data

Nov. 28, 1995 [JP] Japan ..... 7-309368

[51] Int. Cl.[6] ..... F02D 9/08

[52] U.S. Cl. ..... 123/335; 123/73 V; 123/198 D; 123/337

[58] Field of Search ..... 123/334, 335, 123/336, 337, 73 V, 442, 41.15, 198 D, 394; 60/285, 302

[56] References Cited

U.S. PATENT DOCUMENTS

| | | | |
|---|---|---|---|
| 2,904,025 | 9/1959 | Scherenberg et al. | 123/336 |
| 3,371,634 | 3/1968 | Lalande | 123/394 |
| 4,323,040 | 4/1982 | Blocki | 123/394 |
| 4,861,291 | 8/1989 | Koike | 440/1 |
| 4,971,006 | 11/1990 | Imaeda | 123/400 |
| 4,995,370 | 2/1991 | Imaeda et al. | 123/583 |
| 5,020,492 | 6/1991 | Kanno | 123/198 D |
| 5,346,417 | 9/1994 | Isogawa | 440/89 |
| 5,387,163 | 2/1995 | Sakamoto et al. | 477/100 |

*Primary Examiner*—Willis R. Wolfe
*Assistant Examiner*—Hieu T. Vo
*Attorney, Agent, or Firm*—Knobbe, Martens, Olson & Bear LLP

[57] ABSTRACT

An internal combustion engine having at least one variable volume combustion chamber with an intake passage leading thereto, an ignition element for igniting an air/fuel mixture in the chamber, an exhaust passage leading therefrom and including a catalyst in communication therewith, and an emission control for controlling the emission content is disclosed. Preferably, the emission control comprises a mechanism for closing the intake passage leading to the chamber in the event an engine abnormality is detected and an engine ignition misfire mode is employed, thereby preventing the emission of unburned air and fuel into the exhaust passage leading to the catalyst.

13 Claims, 4 Drawing Sheets

TWO CYCLE ENGINE PROVIDED WITH CATALYST

FIELD OF THE INVENTION

The present invention relates to a two cycle internal combustion engine having a catalytic converter, and more particularly, to such an engine which includes an emission control for preventing fouling of the catalyst.

BACKGROUND OF THE INVENTION

Use of catalytic converters with engines used to power automobiles are well known. These converters generally comprise a honeycomb structure positioned within an outer housing. The honeycomb structure is coated with platinum and rhodium. Exhaust gas from the engine is routed into the converter housing to the coated honeycomb structure. There, catalysis occurs, whereby carbon monoxide and hydrocarbons are oxidized to form carbon dioxide and water, and oxides of nitrogen are reduced to form nitrogen.

Catalytic converts are also used with two-cycle engines used to power watercraft. Conversion of exhaust gases from these engines is especially important because the exhaust gases therefrom are typically routed into the water. The exhaust gas may react with the water to form acids and other undesirable compounds, and may also be released from the water to the atmosphere.

A problem arises, however, with use of catalytic converters in these watercraft engines when the engine includes a engine control which includes a misfiring operational control mode. It is often common to employ an engine control in which the engine speed is controlled to correct engine abnormalities such as overheating. In these systems, when an engine abnormality is detected, one or more of the ignition elements corresponding to one or more of the combustion chambers of the engine are misfired so that incomplete combustion occurs in those chambers.

A problem associated with this incomplete combustion is that an unburned air and fuel component is exhausted from these combustion chambers to the exhaust system. The unburned fuel may foul a catalytic converter, and the risk exists that the mixture will ignite within the converter and cause serious damage thereto.

A means for preventing the fouling of a catalytic converter of a two-cycle engine having an engine control is desired.

SUMMARY OF THE INVENTION

In accordance with the present invention, there is provided a means for controlling the exhaust emission of an internal combustion engine so as to prevent catalyst fouling. More particularly, the means for controlling is adapted to prevent fouling of the catalyst in the event an engine control mode is employed in which the ignition element(s) of the engine are misfired.

The emission control comprises means for closing the intake passage leading to each combustion chamber. Preferably, the intake passages corresponding to those combustion chambers which are being misfired are restricted. In this manner, the flow of air and fuel to misfired combustion chambers is prevented, thus preventing unburned air and fuel from being exhausted from the chamber to the catalyst.

In accordance with a first embodiment emission control of the present invention, a secondary valve is provided in each intake passage leading to a crankcase chamber of a two-cycle engine having at least one variable volume combustion chamber. The secondary valve is positioned downstream of a throttle valve. The secondary valve preferably comprises a plate member movably mounted within the intake passage on a shaft. A linkage is connected at one end to the shaft and at the other to a solenoid. In the event an engine abnormality is detected and an engine ignition misfire mode is employed, the solenoid is activated and closes the secondary valve, preventing the flow of air/fuel through the misfiring chamber to the catalyst.

In accordance with a second embodiment emission control of the present invention, the throttle valve positioned within each intake passage corresponding to each combustion chamber of the engine is connected via a linkage to a solenoid. In this embodiment of the invention, in the event an engine misfire mode is employed, the solenoid is activated so as to close the throttle valve, and thus the intake passage.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided a means for controlling the exhaust emission of an engine.

Figure 1:
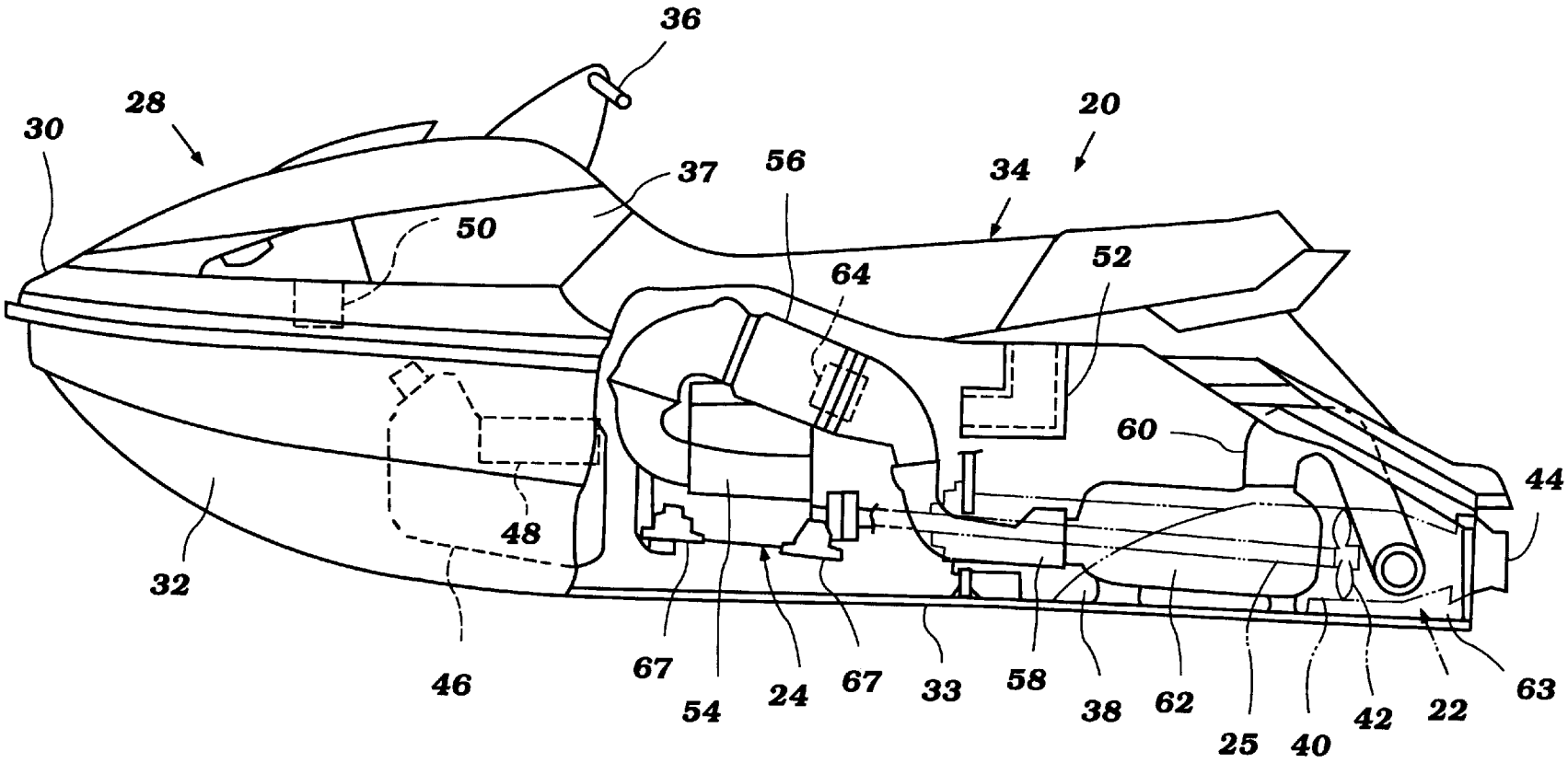
FIG. 1 is a side view, partially cut-away, illustrating a watercraft having an engine including the emission control mechanism in accordance with the present invention.

FIG. 1 illustrates a watercraft 20 of the jet propulsion type wherein the watercraft sucks in water through an intake and ejects it rearward. The watercraft 20 includes a propulsion unit 22 for propelling the water, the propulsion unit powered by an engine 24 of the type which includes an engine emission control 26 in accordance with the present invention.

In general, the watercraft 20 includes a hull 28 having a top portion 30 and a lower portion 32. A seat 34 is positioned on the top portion 30 of the hull 28. A steering handle 36 is provided adjacent the seat 34 for use by a user in directing the watercraft 20.

The hull 28 defines therein an interior space in which is positioned the engine 24. The engine 24 has an output shaft 25 which rotationally drives the propulsion unit 22 which extends out a rear end of the lower portion 32 of the hull 28. The lower portion 32 of the hull 28 includes an intake port 38 which is in communication, via a passage 40 of the propulsion unit 22 in which an impeller 42 is disposed, with a nozzle 44. The nozzle 44 is mounted for movement up and down and to the left and right, whereby the direction of the propulsion force for the watercraft 20 may be varied.

Fuel is supplied to the engine 24 from a fuel tank 46 positioned within the hull 28 of the watercraft 20 forward of the engine 24. An oil tank 48 is similarly situated. Fuel is supplied from the fuel tank 46 to the engine 24 through an appropriate fuel line (not shown).

A combustion air supply is also provided to the engine 24 for use in the fuel combustion process. Outside air is routed through a pair of ducts 50,52 to the engine 24.

Exhaust gas generated by the engine 24 is routed from the engine to an exhaust manifold 54. The exhaust manifold 54 extends to an expansion pipe 56, which in turn is connected to front and rear exhaust pipes 58,60. Between the exhaust pipes 58,60 is positioned a water lock 62. The rear exhaust pipe 60 opens into the water through a pump chamber 63 in which the jet passage 40 is disposed. A catalyst 64 is positioned within the expansion pipe 56 for converting the certain of the exhaust gas products.

As best illustrated in FIG. 1, the engine 24 is preferably of the three-cylinder, two-cycle variety. One skilled in the art will appreciate that the engine emission control 26 of the present invention may be adapted for use with engines of other types and configurations.

The engine 24 has a block 66 having a head 68 connected thereto. The block 66 is connected to a bottom portion 33 of the lower portion 32 of the hull 28 via dampeners 67. The engine 24 is accessible through an engine hatch 37.

The engine block 66 and head 68 define three variable volume combustion chambers 69. Each chamber preferably comprises a cylinder having a piston 70 movably mounted therein. Each piston 70 is connected by a connecting rod 72 to a crankshaft 74 positioned within a crankcase chamber 80. The crankcase 80 is divided into chambers corresponding to each combustion chamber, each crankcase chamber in communication with its respective combustion chamber. The output shaft 25 is connected to the crankshaft 74 of the engine 24 for rotation thereby.

An ignition element 76 is provided for igniting an air/fuel charge in each combustion chamber.

Figure 2:
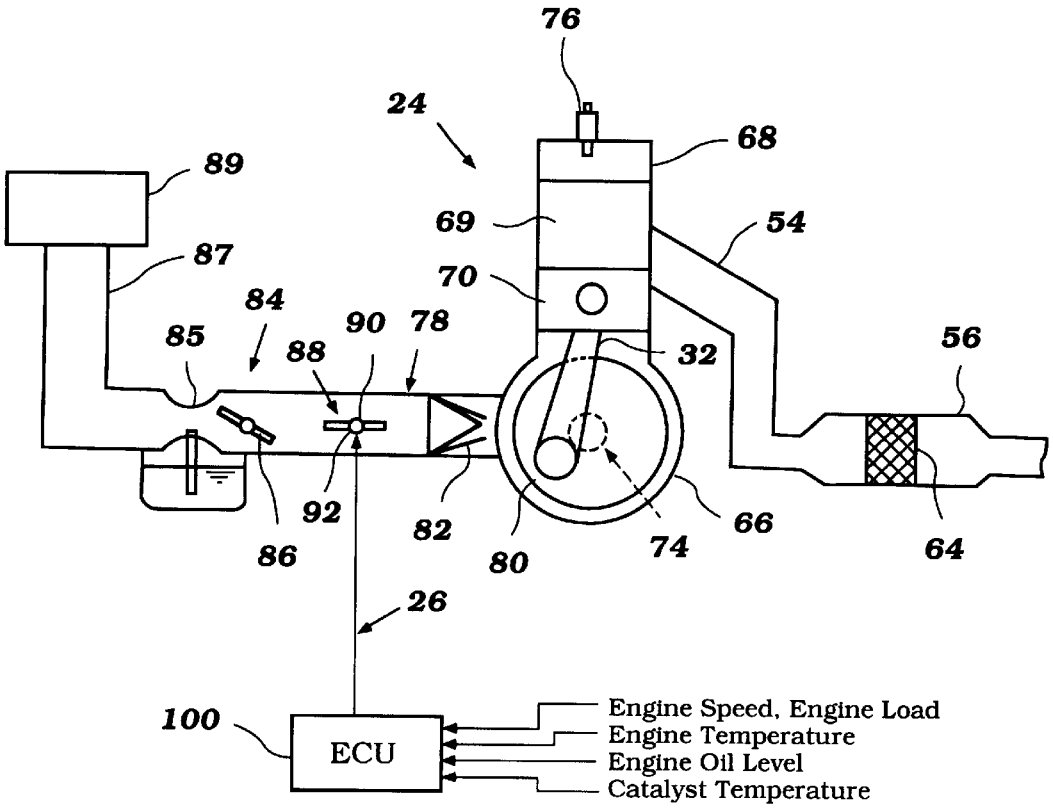
FIG. 2 is a schematic view of an emission control mechanism in accordance with a first embodiment of the present invention, the emission control mechanism including a secondary valve positioned within an intake passage.

As best illustrated in FIG. 2, the outside air which is drawn into the ducts 50,52 enters engine intake passages 78, one each of which communicates with each crankcase chamber 80. A reed valve 82 is positioned within each intake passage 78. The reed valve 82 automatically opens to introduce intake air when the pressure within the crankcase chamber 80 is low when the piston 70 ascends, while the reed valve 82 closes to prevent air from escaping the crankcase chamber 80 when the pressure therein is raised by the piston's 70 decent.

A carburetor 84 is provided for introducing fuel into the incoming air passing through each intake passage leading to each combustion chamber. Each carburetor 84 has a butterfly-type throttle valve 86 positioned downstream of a venturi 85 thereof, for varying the intake passage's 78 cross-sectional area, and thus the volume of air passing therethrough. Air is introduced to the carburetor 84 from an air pipe 87 leading from the air inlet ducts 50,52. A common silencer 89 is used in conjunction with the air pipes 87.

The position of the throttle valve 86 is controlled, via a linkage, by an operating cable (not shown). The opposite end of the operating cable is attached to a throttle control lever (not shown) mounted on the steering handle 36, whereby the operator of the watercraft 20 may open and close the valve 86 with the lever.

Figure 3:
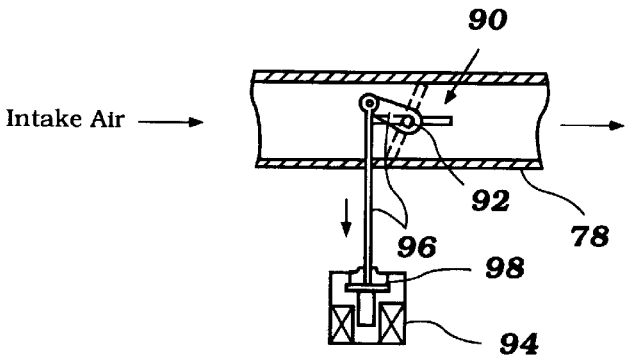
FIG. 3 is an enlarged view of the valve illustrated in FIG. 2.

In accordance with the present invention, the engine 24 includes an emission control mechanism 26. In the preferred embodiment, the emission control mechanism 26 comprises a secondary intake passage control valve 88. This valve 88 is positioned downstream of the throttle valve 86 within each intake passage 78 before the reed valve 82. Preferably, the valve 88 comprises a plate 90 positioned within the intake passage 78, the plate mounted to a shaft 92. The shaft 92 extends beyond the passage 78. Means are provided for moving the valve 88. Preferably, this means comprises a solenoid 94 connected to the shaft 92 via a linkage 96. A spring 98 biases the valve plate 90 into a fully open position, as illustrated in FIG. 3.

The solenoid 94 is controlled by an engine control unit (ECU) 100. The ECU 100 receives engine speed data from an engine speed sensor, engine load from a throttle opening sensor, engine temperature from a temperature sensor, and other information from sensors well known to those skilled in the art. This ECU 100 is of the type that when an engine overheat condition (or similar engine abnormality) is detected via the engine temperature sensor, the ECU 100 carries out an engine speed restraining control. Preferably, this control comprises the suspending of the ignition of or more or even all combustion chambers.

Preferably, when the ECU 100 carries out the engine speed restraining control, it sends an engine abnormality signal to the solenoid 94. When this signal is received, the solenoid 94 rotates the secondary valve 88 closed for each cylinder in which combustion is suspended.

Similarly, if the ECU 100 receives a low oil signal from a oil level detector or an out of range detected catalyst temperature from a temperature sensor, the ECU 100 preferably carries out the same engine abnormality function, restraining the ignition firing of one or more cylinders and sending a signal to the solenoid 94. Optionally, when the ECU 100 detects an engine abnormality, it may signal the lighting of an engine abnormality indicator light or sound a buzzer.

The effect of the engine emission control 26 of the present invention upon engine emission output is as follows. When the ECU 100 detects an engine abnormality, it initiates in the engine speed restraining control. At the same time, the ECU 100 closes the secondary valve 88 corresponding to the intake passage 78 leading to those cylinders which are not being fired. Closing of the valve 88 has the effect of preventing air and fuel from being introduced into that cylinder and then passing unburned into the catalyst 64. In addition, an indicator light is lighted and/or a buzzer sounded to inform the watercraft 20 operator of the engine abnormality. The engine abnormality is hopefully avoided by the lowered engine speed, after which time the ECU 100 may instruct a return to normal engine operating conditions (including a re-opening of the secondary valve 88).

Figure 4:
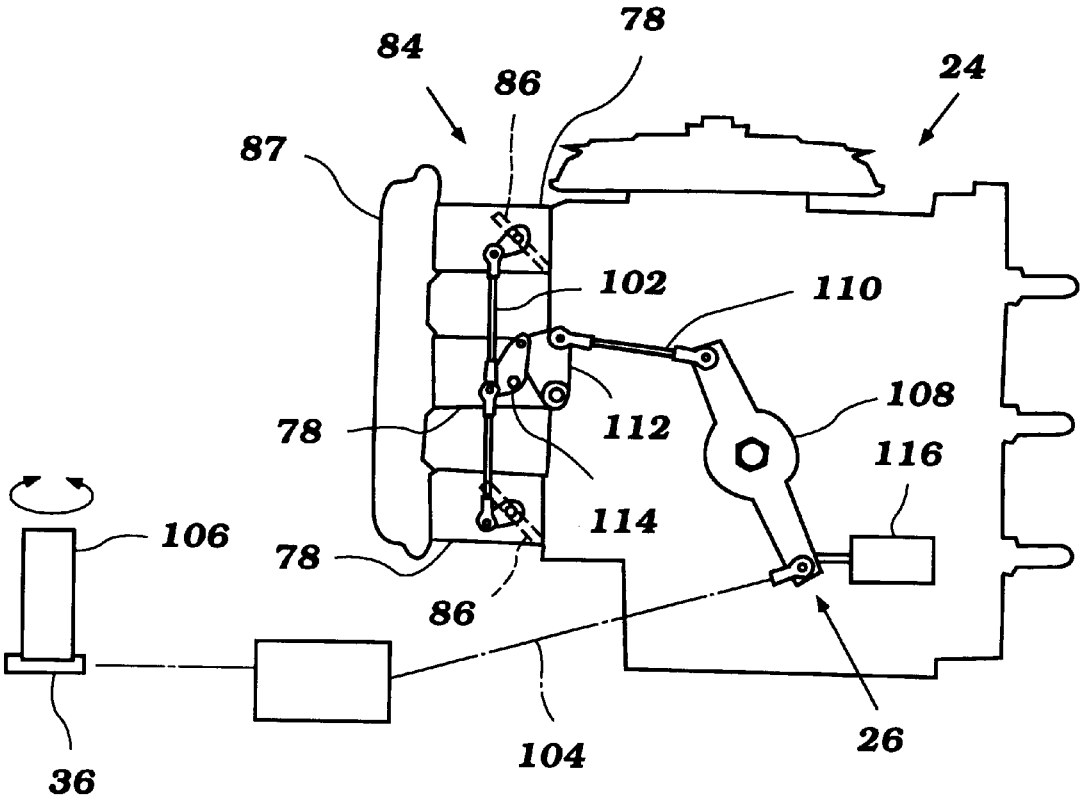
FIG. 4 illustrates a second embodiment emission control mechanism in accordance with the present invention, the mechanism including an actuating mechanism for closing the throttle valves of the engine.
Figure 5:
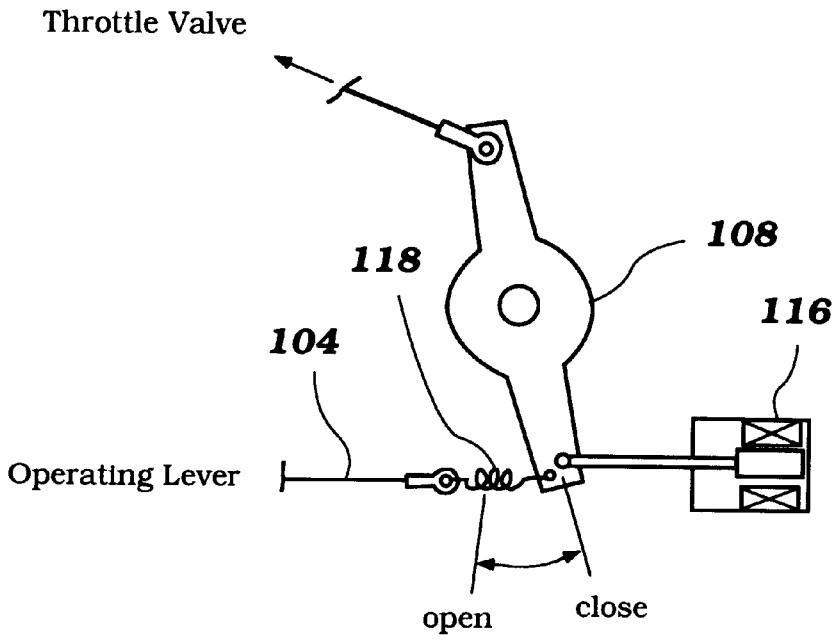
FIG. 5 is an enlarged view of the actuating mechanism illustrated in FIG. 4.

FIGS. 4 and 5 illustrate a second embodiment engine emission control mechanism 126 in accordance with the present invention. In this embodiment, the numbers of those elements which are common which the first embodiment remain the same. FIG. 4 illustrates each of the intake passages 78 for each of the three combustion chambers of the engine 24. Also illustrated is the air inlet pipe 87 leading to the intake passages 78.

As illustrated, each intake passage 78 has its own carburetor 84, including a throttle valve 86. In this embodiment, all of the throttle valves 86 are connected to one another via a connecting rods 102. The connecting rods 102 are, in turn, connected to the throttle control cable 104 (which has its opposite end connected to the throttle control 106 at the steering handle 36) via a link lever 108, connecting rod 110, and first and second link plates 112,114. The link lever 108 is mounted for rotation in response to movement of the throttle control cable 104. When the link lever 108 moves, it moves the connecting rods 102 (and thus all of the throttle valves 86) via the link plates 112,114 and connecting rod 110.

As illustrated in FIG. 5, this linkage is arranged such that the throttle valves 86 themselves are closed in the event of engine abnormality, as opposed to the first embodiment described above, in which a secondary valve is closed. Preferably, this is accomplished by connecting the lever 108 with a rod to a solenoid 116. The solenoid 116 is arranged to move the link lever 108 to a "closed" position corresponding to that position in which the throttle valves 86 are closed. A spring 118 is positioned between the end of the throttle cable 104 and the link lever 108 to permit this function.

The method of using this second embodiment emission control apparatus 126 is similar to that of the first embodiment 26. Namely, when the ECU 100 detects an engine abnormality and initiates a misfire mode, the ECU 100 sends a signal to the solenoid 116, causing the solenoid to close the throttle valves 86.

Figure 6:
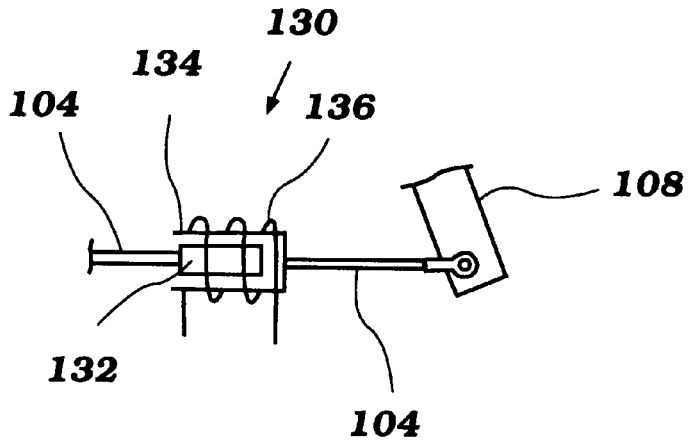
FIG. 6 is an enlarged view of another actuating mechanism in the alternative to that illustrated in FIG. 5.

FIG. 6 illustrates another means for effectuating the closure of the throttle valves 86. As illustrated therein, a piston-cylinder type actuating device 130 is positioned along the length of the throttle cable 104. The piston/cylinder actuating device 130 comprises a piston member 132 positioned on a first end portion of the cable, the piston member 132 located in a cylinder member 134 which is attached to another end of the cable. The piston and cylinder members 132,134 are moved with respect to one another by an electromagnetic coil 136. As illustrated, the portion of the throttle cable 104 which is connected to the cylinder member 134 is connected to the link lever 108.

Using the actuator member 130 illustrated in FIG. 6, if an engine abnormality is detected, the ECU 100 energizes the coil 136, elongating the member. This has the effect of moving the lever 108, and thus the throttle valves 86 connected thereto by linkage, to its closed position.

Of course, the foregoing description is that of preferred embodiments of the invention, and various changes and modifications may be made without departing from the spirit and scope of the invention, as defined by the appended claims.

What is claimed is:

1. An internal combustion engine having a plurality of variable volume combustion chambers, a plurality of intake passages each leading to a respective one of said combustion chambers for delivering at least an air charge thereto, charge forming means for delivering a fuel charge to each of said combustion chambers, a plurality of ignition elements each associated with a respective one of said combustion chambers for igniting an air/fuel mixture within said combustion chambers, a plurality of exhaust passages each leading from a respective one of said combustion chambers for routing exhaust gases from said combustion chambers, a catalyst positioned in communication with said exhaust passages, means for detecting an engine abnormality, means for discontinuing the combustion in at least one of said combustion chambers upon the sensing of an engine abnormality for limiting the speed of said engine and means for restricting the communication of the combustion chambers in which combustion is discontinued with said catalyst upon detection of said engine abnormality.

2. The internal combustion engine in accordance with claim 1, wherein said means for restricting the communication comprises a valve is positioned within said intake passage and said means for closing said valve.

3. The internal combustion engine in accordance with claim 1, means for discontinuing comprises means for misfiring said ignition element upon detection of said engine abnormality.

4. The internal combustion engine in accordance with claim 1, further including a throttle valve, said throttle valve positioned within said intake passage, and wherein said means for restricting the communication comprises a solenoid connected to said throttle valve for closing said throttle valve.

5. The internal combustion engine in accordance with claim 1, wherein said engine comprises a crankcase compression, two cycle engine, said engine having a plurality of crankcase chambers each in communication with a respective one of said combustion chambers, an intake passage leading to each crankcase chamber.

6. The internal combustion engine in accordance with claim 5, further including a plurality of reed-type valves for controlling the flow into said crankcase chambers.

7. The internal combustion engine in accordance with claim 1, wherein said combustion chamber contains a piston, said piston is connected to a crankshaft, and said crankshaft is connected in driving relationship to a propeller for powering a watercraft.

8. A method of controlling the exhaust emission of an internal combustion engine having a plurality of variable volume combustion chambers, a plurality of intake passages each leading to a respective one of said combustion chambers for introducing an air charge thereto, each of said intake passages having a flow area, means for forming a air/fuel mixture in said combustion chambers, a plurality of ignition elements each for igniting said mixture in a respective one of said combustion chambers, a plurality of exhaust passages each leading from a respective one of said combustion chambers, and a catalyst in communication with said exhaust passages, comprising the steps of detecting an engine abnormality, misfiring at least one of said ignition elements in response to said engine abnormality, and restricting the flow of gasses from the combustion chamber associated with the misfired ignition element to the catalyst.

9. The method in accordance with claim 8, wherein said engine includes a throttle valve positioned within each of said intake passages and said restricting step comprises closing the respective throttle valve.

10. The method in accordance with claim 8, further including the step of sounding an audible signal in the event an engine abnormality is detected.

11. The method in accordance with claim 8, further including the step of lighting a light in the event an engine abnormality is detected.

12. A two-cycle internal combustion engine having at least one variable volume combustion chamber, a crankcase chamber in communication with said combustion chamber, an intake passage leading to said crankcase chamber for introducing an air/fuel mixture to said crankcase chamber and therethrough to said combustion chamber, an ignition element for igniting an air/fuel mixture within said combustion chamber, an exhaust passage leading from said chamber for routing exhaust gases from said combustion chamber, a catalyst positioned in communication with said exhaust passage, means for detecting an engine abnormality, a throttle valve positioned within said intake passage and a secondary valve comprising a plate positioned within said intake passage downstream of said throttle valve and connected to a shaft extending from said passage positioned within said intake passage, and means for closing said secondary valve plate upon detection of said engine abnormality comprising a solenoid for rotating said shaft.

13. A method of controlling the exhaust emission of a two-cycle internal combustion engine having at least one variable volume combustion chamber, a crankcase chamber in communication with said combustion chamber an intake passage leading to said crankcase chamber for introducing an air/fuel mixture thereto and therethrough to said combustion chamber, said intake passage having a flow area, a throttle valve positioned within said intake passage and a secondary valve positioned within said intake passage, an ignition element for igniting said mixture, an exhaust passage leading from said combustion chamber, and a catalyst in communication with said exhaust passage, comprising the steps of detecting an engine abnormality, misfiring said ignition element in response to said engine abnormality, and reducing the flow area of said intake passage upon detecting said engine abnormality by actuating said solenoid connected to said secondary valve.

* * * * *